United States Patent [19]

Pace

[11] 4,063,540

[45] Dec. 20, 1977

[54] METHOD AND APPARATUS FOR FUEL RECOVERY IN INTERNAL COMBUSTION ENGINES

[75] Inventor: Antonino Pace, Turin, Italy

[73] Assignee: Fiat Societa per Azioni, Turin, Italy

[21] Appl. No.: 653,311

[22] Filed: Jan. 28, 1976

[30] Foreign Application Priority Data

Jan. 31, 1975 Italy ..... 67242/75

[51] Int. Cl.[2] ..... F02M 33/02

[52] U.S. Cl. ..... 123/119 R; 123/DIG. 2; 261/55; 261/DIG. 21

[58] Field of Search ..... 123/119 R, DIG. 2; 261/DIG. 21, 55

[56] References Cited

U.S. PATENT DOCUMENTS

| | | | |
|---|---|---|---|
| 1,147,644 | 7/1915 | Reichenbach | 123/DIG. 2 |
| 2,098,391 | 11/1937 | Irvin | 123/DIG. 2 |
| 3,186,390 | 6/1965 | Galic | 123/119 D |

*Primary Examiner*—Douglas Hart
*Attorney, Agent, or Firm*—Sughrue, Rothwell, Mion, Zinn and Macpeak

[57] ABSTRACT

Apparatus and method for recovering fuel from the induction system of an internal combustion engine having a carburetor, comprising one or a plurality of collectors along the fuel path between the carburetor throttle valve and the inlet valves of the engine, the collectors being in the form of annular recesses in the walls of the ducts, which recesses act to trap fuel which flows back as a liquid condensed onto the inlet manifold pipes as a reaction to the closure of the associated inlet valve of the engine. Each collector is connected by a drainage systems of conduits via expansion tanks and a pump, to the petrol tank of the engine and/or to the inlet to the carburetor whereby fuel which condenses prior to being drawn into the engine can be recycled for vaporization thereby avoiding its entry into the engine as a liquid.

4 Claims, 6 Drawing Figures

METHOD AND APPARATUS FOR FUEL RECOVERY IN INTERNAL COMBUSTION ENGINES

The present invention relates to a method and apparatus for the recovery of excess fuel in the induction system of a carburation type internal combustion engine. In particular, embodiments of the present invention are operable to recover a quantity of the fuel which flows in liquid state through the induction system and which, because it is not vaporised, will not be fully utilised in the combustion. The recovered fuel may be returned to the fuel tank for its eventual reuse, or may be directly recycled to the carburettor for vaporisation and immediate reuse. It is known that in carburation type internal combustion engines the fuel feed from the float chamber of the carburettor to the cylinders is obtained by the vacuum created by the piston in the cylinder during its downward stroke, which acts to draw from the carburettor, through the induction manifold pipes and the induction valves, a flow of petrol/air mixture, which is delivered by the carburettor in a predetermined ratio. It is also known that, for th engine to operate well, the carburettor must deliver the fuel/air mixture at a certain rate whilst the induction valve is open. From observation of the dynamic phenomena accompanying the flow of mixture to the cylinders it has been possible to establish that, when the induction valve is open, the mixture moves with fair regularity inside the induction pipe, with a maximum velocity near the centre of the pipe and a minimum velocity along the walls of the pipe.

However, the induction valve closes, because of the inertia of the fluid which comes up against the wall of the valve, a reverse flow of very rich mixture is generated; this returns towards the carburettor with turbulent flow. A certain proportion of the mixture which flows back along the walls of the induction pipe is in liquid form and tends to remain within the pipe until the next induction stroke of the associated cylinder whereupon it is drawn into the cylinder in the liquid state with the fresh mixture drawn from the carburretor. It does not mix with this mixture, however, and thus does not burn properly in the subsequent combustion stroke and is therefore wasted. It also adds to the pollution of the exhaust gases because of the incomplete combustion.

The present invention seeks therefore to provide a method and apparatus for recovering the excess fuel which is deposited on the walls of the induction pipe and which, in an unvaporised state, runs along the walls of the carburettor in certain operating conditions (for example, upon cold starting this leads to "flooding" of the carburettor, making starting difficult or impossible). The use of embodiments of the invention should also have the effect of reducing the amount of pollutant substances emitted by the exhaust of the engine due to the incomplete combustion of this unvaporised fuel which, instead, can be recycled to the tank or to the carburettor for proper vaporisation and reuse.

According therefore, to one aspect of the present invention there is provided apparatus for recovering fuel from the induction system of an internal combustion engine having a carburettor with one or more barrels, wherein it comprises at least one collection device for collecting the fuel which flows back as a liquid along the induction manifold pipes upon closure of the associated inlet valve, a system of drainage conduits leading from the said collection device to the fuel tank and/or to the inlet of the carburettor, and a pump for driving recovered liquid fuel along the drainage conduits.

According to another aspect, the present invention provides a method for the recovery of fuel for internal combustion engines of the type having at least one carburettor with one or more barrels, wherein fuel which flows as a liquid back along the walls of the induction manifold pipes upon closure of the associated induction valves of the engine is collected and returned to the carburettor for vaporisation or to the fuel tank of the engine.

Various embodiments of the present invention will now be more particularly described, by way of example, with reference to the accompanying drawings, in which.

Figure 1:
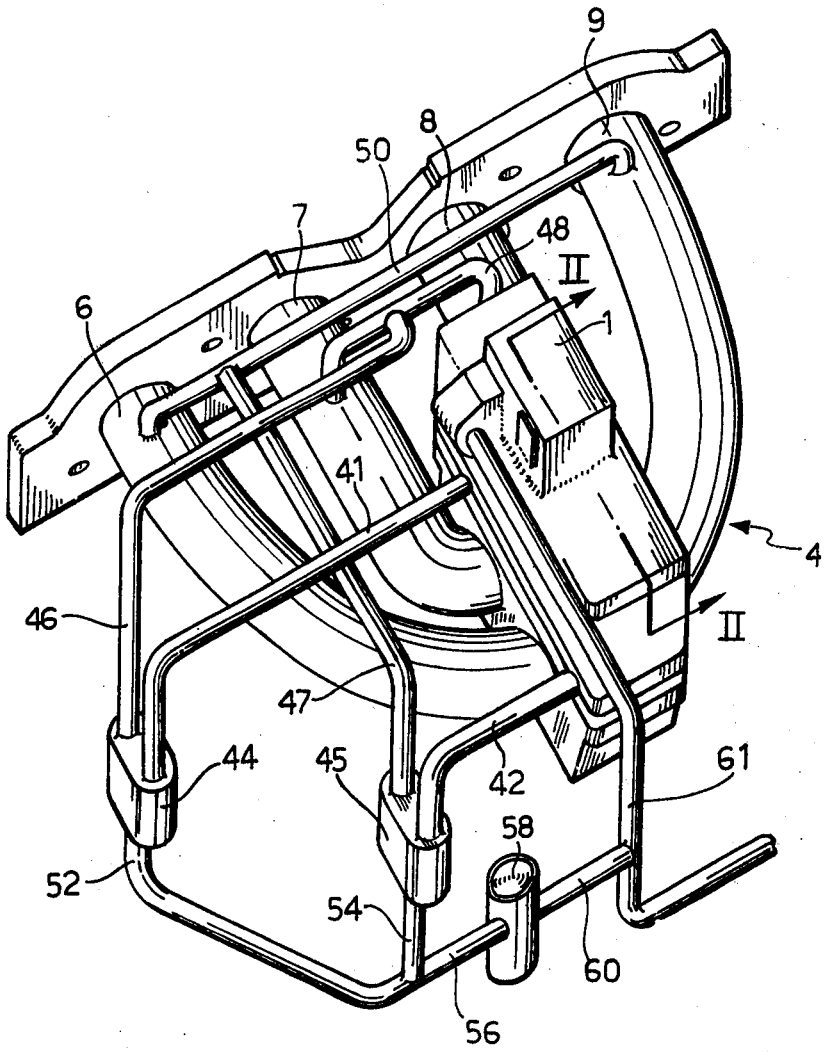
FIG. 1 is a perspective view of a preferred embodiment of the invention for a four cylinder engine with a double choke carburettor.
Figure 2:
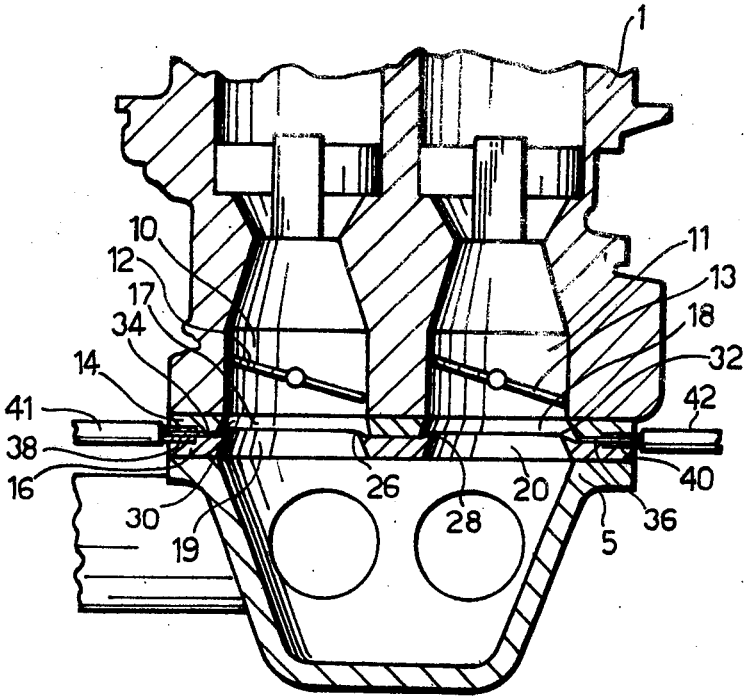
FIG. 2 is a partial section taken on the line II—II of FIG. 1.
Figure 3:
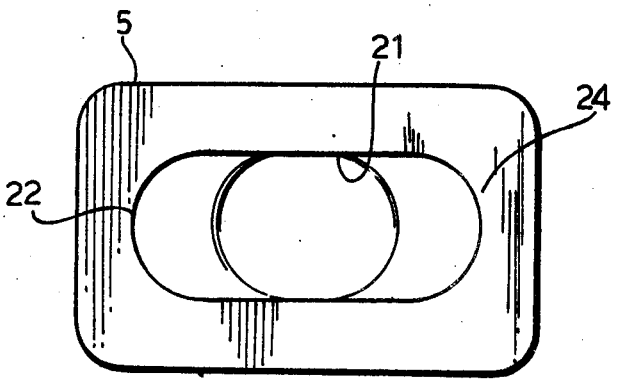
FIG. 3 is a rear view of a detail of the embodiment shown in FIGS. 1 and 2.

Referring now to FIGS. 1 to 3 of the drawings, there is shown a carburettor 1, of the double barrel (or double choke) downdraught type below which there is an induction manifold 4 in the form of a chamber 5 directly under the carburettor from which project laterally four induction pipes 6, 7, 8, 9, two symmetrically on each side, which connect the chamber 5 with cylinders 1, 2, 3, 4 respectively of the engine. In FIG. 1 there is shown, in diagrammatic form, only that part of the cylinder head by which the induction pipes enter. The carburettor 1 has two barrels 10 and 11 each with a respective butterfly valve 12, 13.

Two superimposed spacers 14 and 15 separate the body of the carburettor 1 and the chamber 5 of the induction manifold. The spacers 14 and 16 each have two frusto-conical holes 17, 18 and 19, 20 respectively, and are superimposed in such a way that the two pairs of holes are in register coaxially in pairs and coaxial with the barrels 10, 11 of the carburettor 1. The spacers 14, 16 are oriented so that the smaller diameters of the holes 17, 18 and 19, 20 are nearest to the carburettor 1. The smaller diameter of each of the holes 17, 18 and 19, 20 is equal to the maximum diameter of the associated barrel 10, 11 of the carburettor 1.

The manifold chamber has an inlet 21 in the form of a slot with semicircular ends 22 and 24 which can be seen from FIG. 3 which is a plan view of the manifold chamber 5 without the induction pipes.

The radius of curvature of the semicircular ends 22 and 24 is equal to the radius of curvature of the larger diameter of the holes 17, 18 and 19, 20 which are coaxial with respective barrels 10 and 11 (and also with the associated semicircular ends 22, 24). The inclination of the walls of the frusto-conical sides of the holes 17, 18, 19, 20 is preferably of the order of 10°–20° to the axis of the holes.

The smaller diameter of the holes 19, 20 of the lower spacer 16 are formed with axially projecting rims or lips 26, 28 of frusto-conical form which extend upwardly into the associated holes 17, 18. The inclination of the side walls of these frusto-conical rims or lips 26, 28 is preferably in the region of 45° to 60° with respect to the axis. The rims 26, 28 thus define, between their outer, frusto-conical walls and the frusto conical internal walls of the associated holes 17 and 18 of the upper spacer 14, two annular recesses 30, 32 which act as collecting chambers for the fuel which flows back along the walls of the induction pipes towards the carburettor.

The two spacers 14, 16 have mating semi-cylindrical recesses machined in their facing surfaces, which form conduits 34, 36 communicating with the bottom of the chambers 30 and 32 respectively. These conduits 34, 36 are fitted with unions 38 and 40 which are coaxial therewith and which connect them to respective pipes 41, 42 which lead from the carburettor to provide a drainage path for the liquid fuel collected in the annular chambers 30, 32. The two pipes 41 and 42 lead to respective expansion boxes 44, 45. The conduits 34, 36, and their unions 38, 40 may be arranged in any convenient position around the annular chambers compatible with the requirement to provide a suitable drainage path for liquid collected in the carburettor 1. In FIG. 1 the pipes 41, 42 are shown leading from the spacers in a direction transverse the section line II—II, whilst in FIG. 2, for convenience of representation in the drawing, the pipes 41 and 42 have been shown leading from the carburettor parallel to the section line II—II.

Two pipes 46 and 47, appropriately shaped and leading from the expansion chambers 44 and 45 are connected, the first to an intermediate point of another pipe 48 the ends of which communicate with the induction pipes 7 and 8 of No. 2 and No. 3 cylinders, and the second to an intermediate point of a pipe 50 the ends of which communicate with induction pipes 6 and 9 leading to No. 1 and No. 4 cylinders.

Also leading from the expansion chambers 44 and 45 are further pipes 52 and 54 which lead to a common inlet pipe 56 which in its turn leads into an AC type pump 58 which maintains a pressure difference sufficient to feed the collected fuel along an output pipe 60 back to the petrol tank (not shown) from which it was initially drawn. In engines fitted with fuel recycling systems, such as that shown in FIG. 1, where there is a pipe 61 connected between the float chamber of the carburettor and the petrol tank (not shown) it is sufficient merely to connect the outlet pipe 60 from the pump 58 into an intermediate point along the pipe 61.

The operation of the system described above is as follows:

When the induction valves are open the mixture delivered by the carburettor flows in a regular manner into the combustion chambers of the engine through the induction manifold 5 and the appropriate induction pipes 6, 7, 8, 9. As soon as an induction valve closes, however, the inertia of the fluid coming up against the closed valve generates a reverse flow of the mixture which returns turbulently towards the carburettor. The reverse flow of the mixture tends to condense on the walls of the manifold and this liquid is collected in the annular chambers 30 and 32 and drained off through the conduits 34, 36, the unions 38, 40 and the pipes 41, 42 towards the expansion chambers 44 and 45. The pipes 46, 47, 48, 50, leading from the expansion chambers 44, 45 are so connected to the induction pipes 6, 7, 8, 9 that there is always one cylinder of the pair to which one expansion chamber is connected on its induction stroke when the other is on its compression stroke i.e. when the inlet valve has just closed, so that there is always a vacuum in the expansion chamber when the turbulent reverse flow of mixture occurs.

Due to the vacuum within the expansion chambers 44 and 45, the fuel vapour and liquid fuel drawn into the chamber are separated, the fuel vapours being drawn up along the pipes 46, 47 to whichever of the cylinders is at that time on its induction stroke. The liquid petrol is drawn from the expansion chambers 44 and 45 along the pipes 52, 54 and 56 by the pump 58, and from there passed along the pipe 60 either to the petrol tank (not shown), or to the carburettor through the fuel pipe 61, for its direct reuse.

Figure 4:
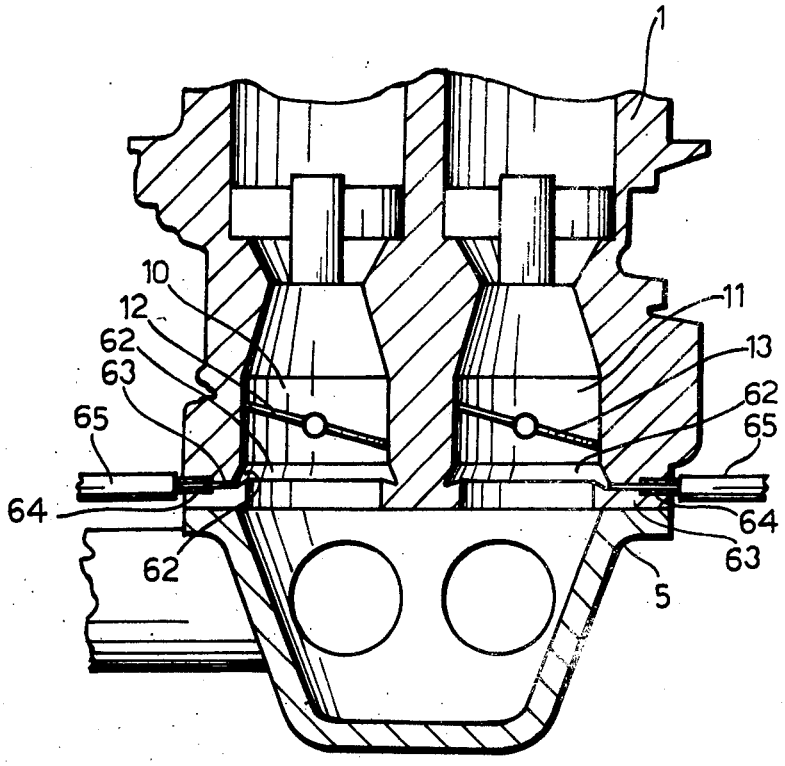
FIG. 4 is a sectional view of a part of a second embodiment.

A preferred embodiment of the invention has been described above, from which, it is believed, best results may be obtained. However, different variations may give results almost if not equally as good. For example, the collection chambers 30, 32 may be located in a different position between the throttle valve of a body of the carburettor and the cylinder head. In detail, the collection chambers may be formed, as shown in FIG. 4, as annular recesses 62 machined in the inside walls of the barrels 10 and 11 of the carburettor, with their walls having the same inclination with respect to the axes of the barrels as are given above for the embodiment of FIGS. 1 to 3. Drainage ducts 63, connectors 64 and pipes 65 lead to a system similar to that shown in FIG. 1.

Figure 5:
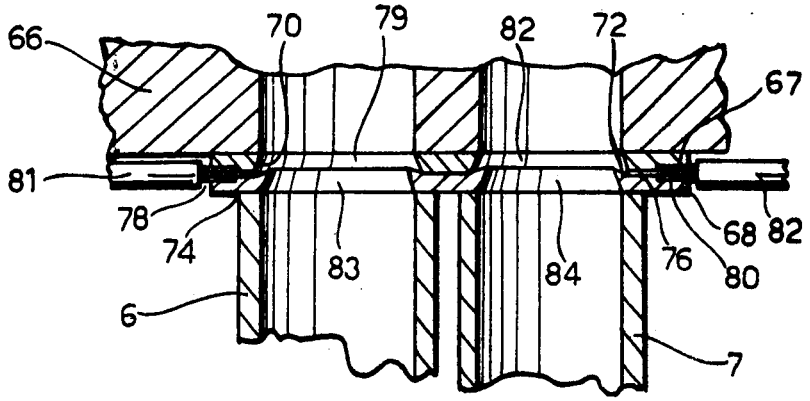
FIG. 5 is a sectional view of part of a third embodiment.

Alternatively, as shown in FIG. 5, the collection chambers may be annular recesses 70, 72 formed be the inclined walls of frusto conical holes 79, 82, 83, 84 in spacers 67, 68 between the manifold pipes 6, 7, 8, 9 and the cylinder head 66, the walls of the holes 79, 82, 83, 84 having the same characteristic inclination with respect to the axes thereof as in the previous embodiments. In this last example, as in the other embodiments, small bores 74, 76 communicate with the annular collection chambers 70, 72, and are linked by connectors 78, 80, to pipes 81, 82 of a drainage system similar to that shown in FIG. 1.

Figure 6:
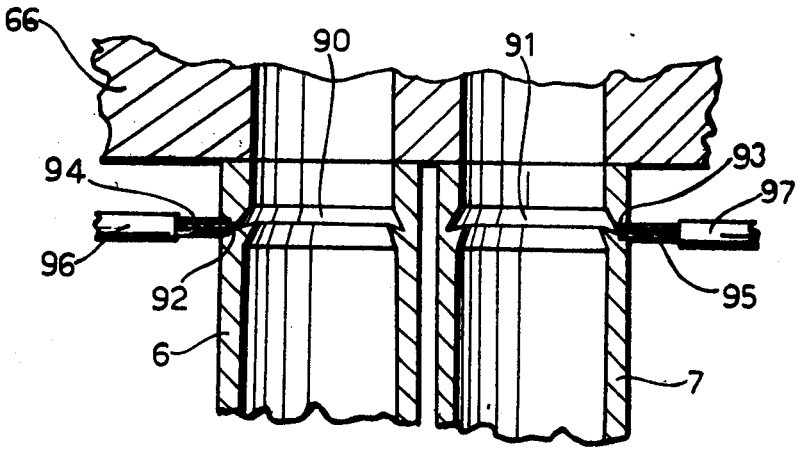
FIG. 6 is a sectional view of a part of a fourth embodiment.

As shown in FIG. 6, annular collection chambers 90, 91 may be machined directly as annular recesses in the walls of the manifold pipes 6, 7, 8, 9 (only 6 and 7 being shown in the drawing but the others being identical). Again drillings 92, 93 linked by connectors 94, 95 to pipes 96, 97 provide for drainage from the collection chambers 90, 91.

Although it is possible to dispense with the expansion chambers and the system will still work, yet in their absence the system is less effective. Likewise it is possible to provide expansion chambers which are not connected up to the pipes of the induction manifold as are the expansion chambers 44, 45 of the embodiment particularly described with reference to FIG. 1. When the expansion chambers are connected to the induction pipes as in the embodiment particularly described, it is preferred that the expansion chambers are maintained under vacuum without rapid or sudden and irregular variations in pressure. It is therefore convenient, as in the embodiments described, to connect the expansion chambers to groups of induction pipes, there being as many such groupings of induction pipes as there are expansion chambers, each expansion chamber being connected to all the induction pipes of a group. For engines having more than four cylinders the groups of induction pipes may be selected so that the different groups and the members of each group have equal relative ignition phase displacement.

I claim:

1. A fuel recovery device for a carburetor of an internal combustion engine comprising a down draft type carburetor having at least one vertical axis barrel, an intake manifold having a plurality of pipes adapted to be connected said engine, a fuel collector disposed between said carburetor at the lower end of each barrel and said intake manifold for collecting fuel condensed in each barrel, expansion chamber means, first conduit means connected between each collector and said expansion chamber means for directing the collected fuel from each collector to said expansion chamber means, second conduit means connected to said expansion chamber means and said pipes for returning vapors from said collected fuel to said pipes and third conduit means leading from said expansion chamber means for returning said fuel for reuse, each collector comprising an annular groove at the lower end of each barrel defined by upper and lower coaxial frusto-conical walls with said lower wall being inclined to the vertical axis of the barrel by an angle in the region of 45° to 60° and said upper wall being inclined to the vertical axis of said barrel by an angle in the region of 10° to 20°.

2. A fuel recovery device as set forth in claim 1 wherein a spacer is secured intermediate said carburetor and said intake manifold having aperture means therethrough corresponding to said barrel of said carburetor, at least one of said frusto-conical walls being defined by said spacer element.

3. A fuel recovery device as set forth in claim 2 wherein said intake manifold has an elongated slot like intake opening, and further comprising a second spacer element, said first spacer element being secured adjacent said carburetor and said second spacer element being secured adjacent said manifold and superimposed with respect to each other, means defining at least one hole of frusto-conical shape in said first spacer, the larger diameter of said hole being nearer said intake manifold, means defining at least one hole of frusto-conical shape in said second spacer element coaxial with said hole in said first spacer element and having its larger diameter nearer said manifold, said hole in said second spacer having a frusto-conical lip surrounding the smaller diameter thereof and projecting towards said carburetor, the smaller diameters of said holes in said first and second spacer elements being substantially equal to the diameter of said barrel of the carburetor and coaxial therewith and the greater diameter of said holes in said first and second spacer elements being substantially equal to the width of said intake opening to said manifold and in register therewith.

4. A fuel recovery device as set forth in claim 1 wherein a plurality of expansion chamber means are provided with each expansion chamber means being connected to a plurality of said pipes.

* * * * *